US012416417B1

(12) United States Patent
Zhu et al.

(10) Patent No.: US 12,416,417 B1
(45) Date of Patent: Sep. 16, 2025

(54) MULTIFUNCTIONAL DEHUMIDIFIER

(71) Applicant: LEIZIG CLIMATE TECHNOLOGIES, INC., Okemos, MI (US)

(72) Inventors: Juan Zhu, Guangdong (CN); Chuhan Lin, Guangdong (CN); Chengqian Cai, Guangdong (CN)

( * ) Notice: Subject to any disclaimer, the term of this patent is extended or adjusted under 35 U.S.C. 154(b) by 0 days.

(21) Appl. No.: 19/031,437

(22) Filed: Jan. 18, 2025

(51) Int. Cl.

| | |
|---|---|
| ***F24F 1/0358*** | (2019.01) |
| ***F24F 1/028*** | (2019.01) |
| ***F24F 1/0323*** | (2019.01) |
| ***F24F 13/02*** | (2006.01) |

(52) U.S. Cl.
CPC ..... *F24F 1/0358* (2019.02); *F24F 1/028* (2019.02); *F24F 1/0323* (2019.02); *F24F 13/02* (2013.01)

(58) Field of Classification Search
CPC ..... F24F 1/0358; F24F 1/028; F24F 1/0323; F24F 13/02; F25B 6/04; F25B 5/04
See application file for complete search history.

(56) References Cited

U.S. PATENT DOCUMENTS

| | | | | |
|---|---|---|---|---|
| 2,924,080 | A * | 2/1960 | Bullock | F24F 1/04 62/262 |
| 2016/0109144 | A1* | 4/2016 | Kim | F24F 1/0323 62/331 |
| 2016/0238269 | A1* | 8/2016 | Kwon | F24F 1/022 |
| 2019/0390881 | A1* | 12/2019 | Bachellor | F25B 41/20 |
| 2021/0199317 | A1* | 7/2021 | Yu | F25B 41/39 |
| 2023/0102678 | A1* | 3/2023 | Xing | F24F 13/20 62/291 |

* cited by examiner

*Primary Examiner* — Joseph F Trpisovsky
(74) *Attorney, Agent, or Firm* — Sam Pierce

(57) ABSTRACT

A multifunctional dehumidifier, including: a second air duct, and an evaporator and a second condenser are sequentially arranged in the second air duct; the second air duct inlet is configured to guide air into the second air duct, the evaporator is configured to cool the wind and release water vapor; the multifunctional dehumidifier also includes a first air duct, and a first condenser is installed inside the first air duct, the first condenser is connected to the second condenser; and a first air duct inlet is provided and configured to guide the air into the first air duct, the first condenser is configured to carry out the heat released from the second condenser, the first air duct outlet is configured to discharge the heat carried out from the first condenser. The multifunctional dehumidifier have both heating dehumidification function and cooling dehumidification function.

6 Claims, 9 Drawing Sheets

MULTIFUNCTIONAL DEHUMIDIFIER

CROSS REFERENCE TO RELATED APPLICATIONS

This application claims foreign priority of Chinese Patent Application No. 202411772934. 7, filed on Dec. 4, 2024 in the China National Intellectual Property Administration, the disclosures of all of which are hereby incorporated by reference.

TECHNICAL FIELD

The present disclosure relates to the technical field of dehumidification equipment, in particular to a multifunctional dehumidifier.

BACKGROUND

In related technologies, dehumidifiers mainly include heating-type dehumidifiers and cooling-type dehumidifiers. A heating-type dehumidifier is an all-in-one unit, with a condenser and evaporator inside the casing. Indoor air passes through the evaporator, where heat is dissipated and the temperature is lowered to reduce humidity. The air then passes through the condenser, where it absorbs heat and warms up to become dry, warm air. The temperature of the dry, warm air is higher than that of the indoor air, and when it is expelled into the room, it raises the indoor temperature. A cooling-type dehumidifier (such as an air conditioner) is a split unit, with the condenser placed outdoors and the evaporator placed indoors. Indoor air passes through the evaporator, where heat is dissipated and the temperature is lowered to reduce humidity, becoming dry, cool air. The temperature of the dry, cool air is lower than that of the indoor air, and when it is expelled into the room, it lowers the indoor temperature. The outdoor air absorbs heat through the condenser and dissipates the heat outdoors. From this, it can be understood that a heating-type dehumidifier can only dehumidify by heating and cannot dehumidify by cooling, while a cooling-type dehumidifier can only dehumidify by cooling and cannot dehumidify by heating.

SUMMARY

The present disclosure provides a multifunctional dehumidifier, to solve the technical problems that a heating-type dehumidifier can only dehumidify by heating and cannot dehumidify by cooling, while a cooling-type dehumidifier can only dehumidify by cooling and cannot dehumidify by heating.

The present disclosure provides a multifunctional dehumidifier, including: a second air duct, and an evaporator and a second condenser are sequentially arranged in the second air duct; the second air duct inlet is configured to guide air into the second air duct, the evaporator is configured to cool the wind and release water vapor, and the second condenser is configured to heat the water vapor to obtain heated water vapor, and a second air duct outlet is provided and configured to discharge the heated water vapor; wherein, the multifunctional dehumidifier also includes a first air duct, and a first condenser is installed inside the first air duct, the first condenser is connected to the second condenser; the first condenser is configured to primary release heat of refrigerant, the second condenser is configured to secondary release heat of refrigerant; and a first air duct inlet is provided and configured to guide the air into the first air duct, the first condenser is configured to carry out the heat released from the second condenser, the first air duct outlet is configured to discharge the heat carried out from the first condenser.

Furthermore, the second air duct inlet and the second air duct outlet are defined on a top of the multifunctional dehumidifier; an airflow direction in the second air duct is as follows: air enters from a back of the second air duct inlet, then turns horizontally, and finally blows out from the second air duct outlet.

Furthermore, the evaporator and the second condenser are installed inside a main body of the multifunctional dehumidifier; and the multifunctional dehumidifier further comprises an air inlet turning pipe, with an end of the air inlet turning pipe is served as the second air duct inlet and another end of the air inlet turning pipe is connected to the main body; and the multifunctional dehumidifier further comprises an air duct outlet turning pipe, an end of air duct outlet turning pipe is connected the main body, and another end of the air duct outlet turning pipe is served as the second air duct outlet.

Furthermore, the air inlet turning pipe is installed on a first side of the main body, and the air duct outlet turning pipe is installed on a second side of the main body.

Furthermore, the multifunctional dehumidifier further comprises a first heat exchanging box, which is installed on a rear wall of the main body; the first air duct is defined within the first heat exchanging box, with the first air duct outlet positioned on the rear wall of the first heat exchanging box and the first air duct inlet positioned on a sidewall of the first heat exchanging box.

Furthermore, a multiple of first air duct inlets are provided, and multiple of the first air duct inlets are located on multiple sidewalls of the first heat exchanging box.

Furthermore, a second fan is installed in the second air duct, and a first fan is installed in the first air duct.

Furthermore, the multifunctional dehumidifier further comprises a compressor and an expansion valve; wherein the compressor is connected to the first condenser, and the first condenser is connected to the second condenser; and the second condenser is connected to the expansion valve, the expansion valve is connected to the evaporator, and the evaporator is connected to the compressor.

Furthermore, a first auxiliary evaporator and a second auxiliary evaporator are installed on the evaporator, the first auxiliary evaporator and the second auxiliary evaporator are connected to the evaporator.

Furthermore, the second air duct and the first air duct are separated by the rear wall of the main body, to avoid heat exchange between the second air duct and the first air duct.

When non-heating dehumidification is required, the user installs the multifunctional dehumidifier in two separate treatment areas, with the outlet of the second air duct facing the indoor area; the outlet of the first air duct is directed towards the outdoor area. The primary heat released by the first condenser is discharged outdoors, without affecting the indoor temperature. Since the second condenser only releases secondary heat, the amount of heat released is less than the amount of heat absorbed by the evaporator. This ensures that the heat received by the air at the second condenser is less than or equal to the heat lost by the evaporator, meaning the outlet air temperature is not higher than the inlet air temperature. Therefore, when the air is discharged into the indoor area, it will not significantly change the original indoor temperature, achieving dehumidification without temperature increase.

When temperature-increasing dehumidification is required, the user places the entire multifunctional dehumidifier indoors, with both the outlet of the second air duct and the outlet of the first air duct facing indoor area. The air from the second air duct first passes through the evaporator to cool down before entering the second condenser for heat absorption and temperature increase. The air from the first air duct passes through the first condenser for heat absorption and temperature increase before leaving the first air duct inlet. Since the total heat supplied by the second condenser and the first condenser is greater than the heat absorbed by the evaporator from the air leaving the second air duct, the air discharged from both the first air duct and second air duct into the indoor will cause the indoor temperature to rise.

DESCRIPTION OF THE REFERENCE NUMERAL

Figure 1:
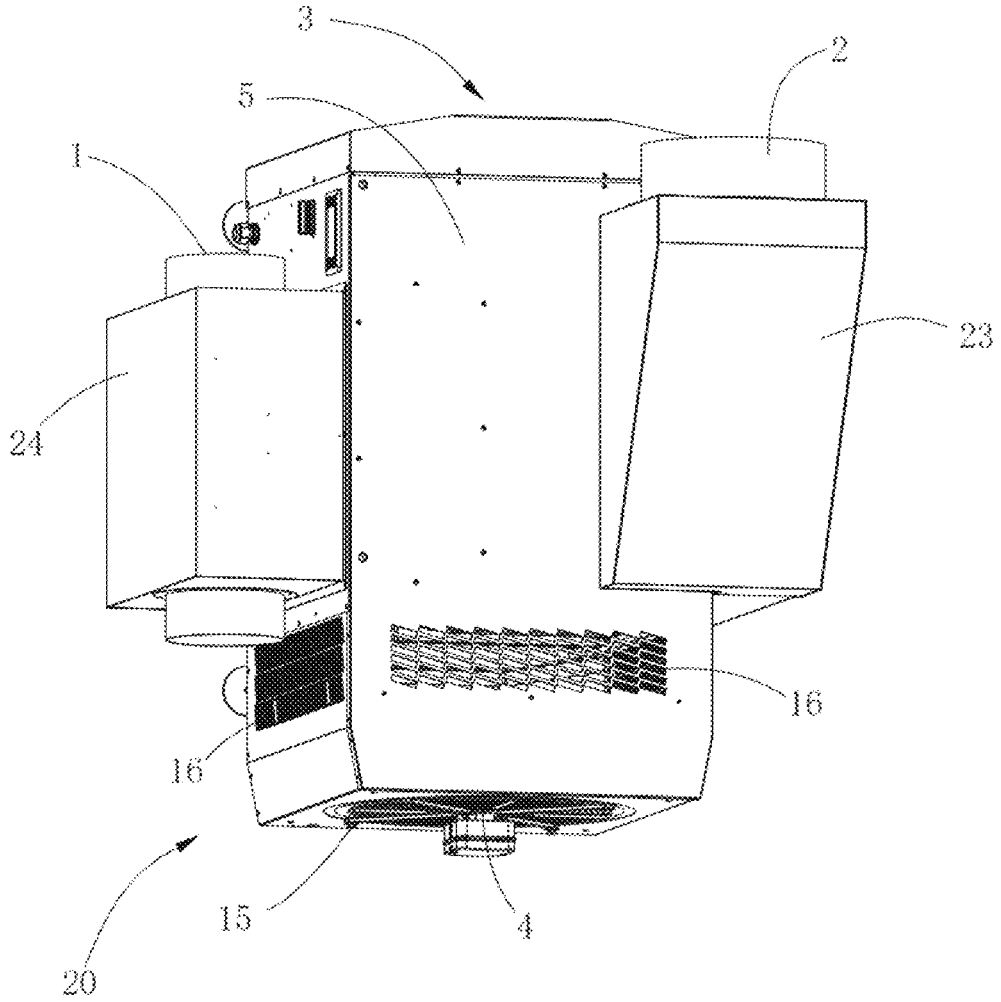
FIG. 1 is a schematic structural diagram of a multifunctional dehumidifier according to an embodiment of the present disclosure.
Figure 2:
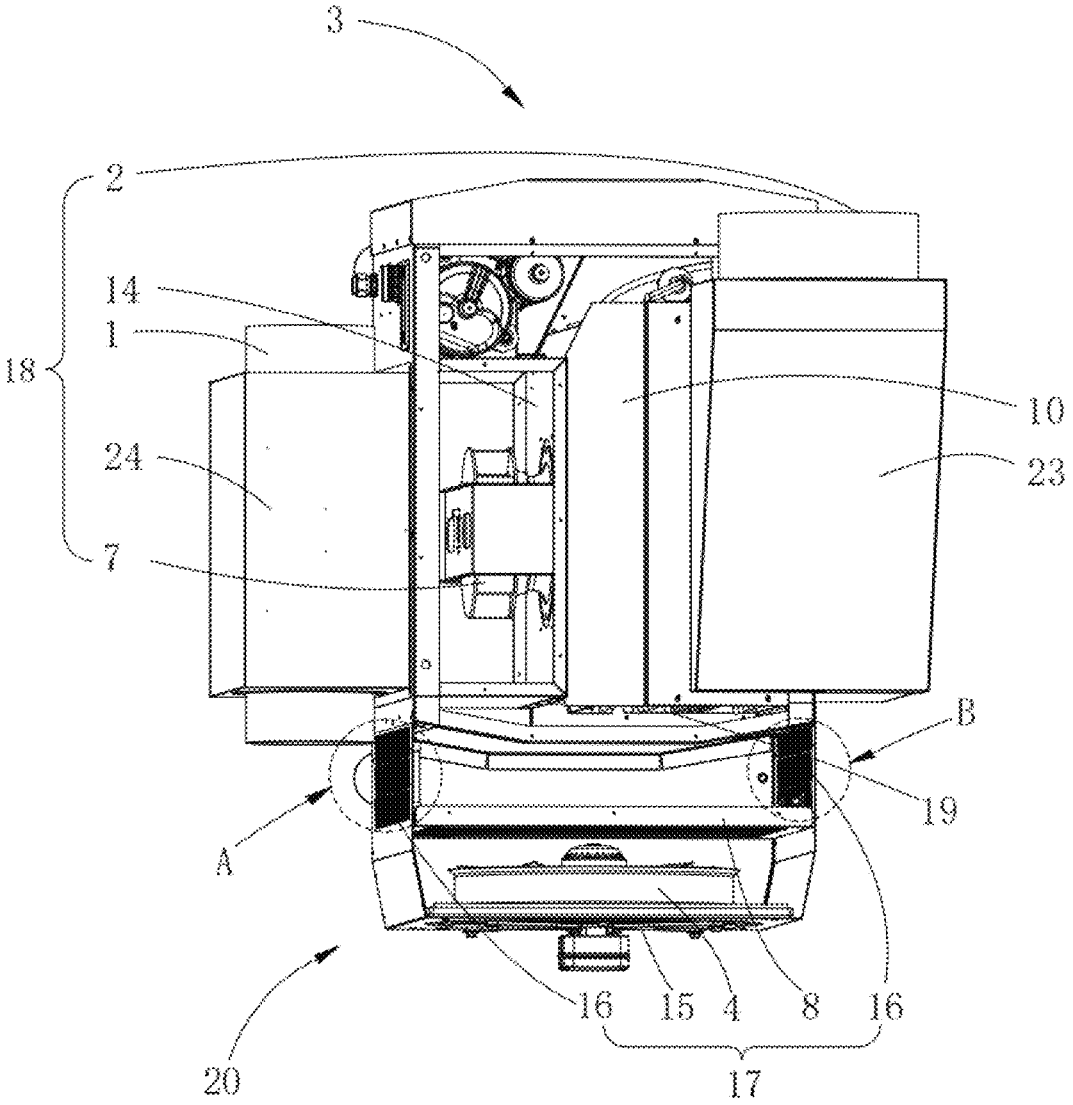
FIG. 2 is a schematic structural diagram of the multifunctional dehumidifier in FIG. 1 from another view, which shows a first side wall of the main body.
Figure 3:
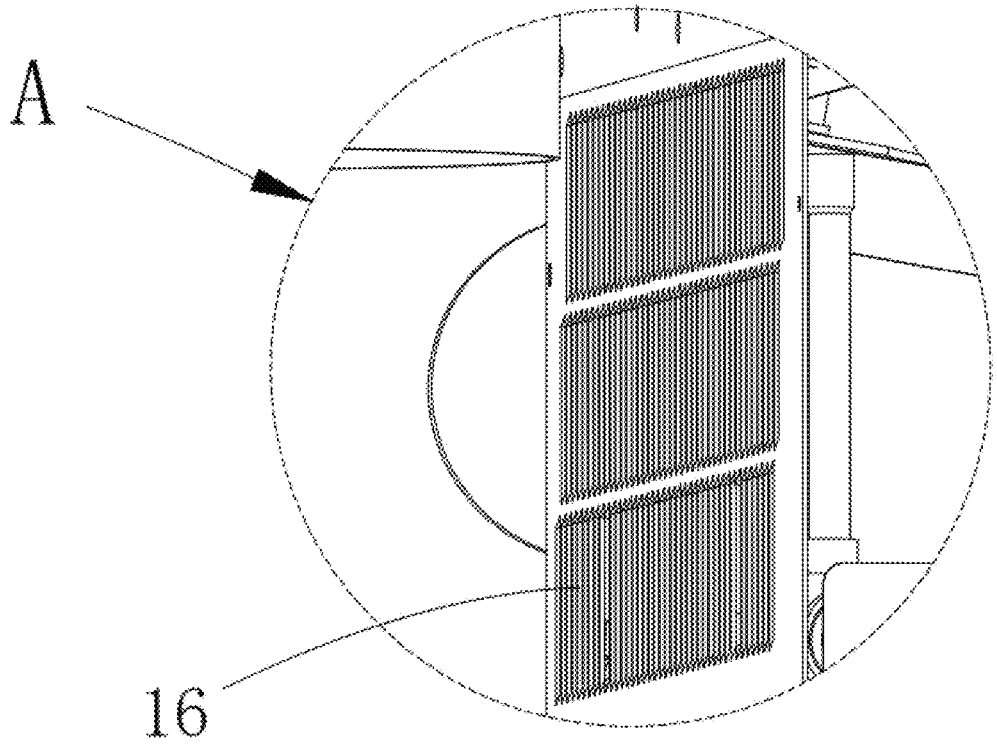
FIG. 3 is an enlarged view of area A in FIG. 2.
Figure 4:
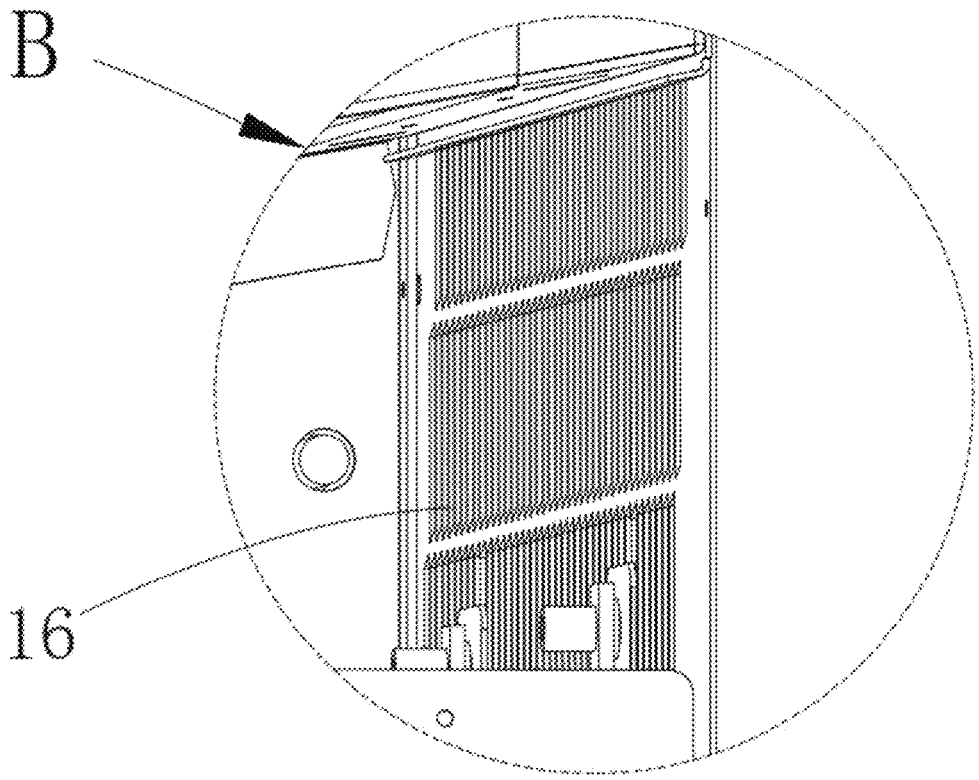
FIG. 4 is an enlarged view of area B in FIG. 2.
Figure 5:
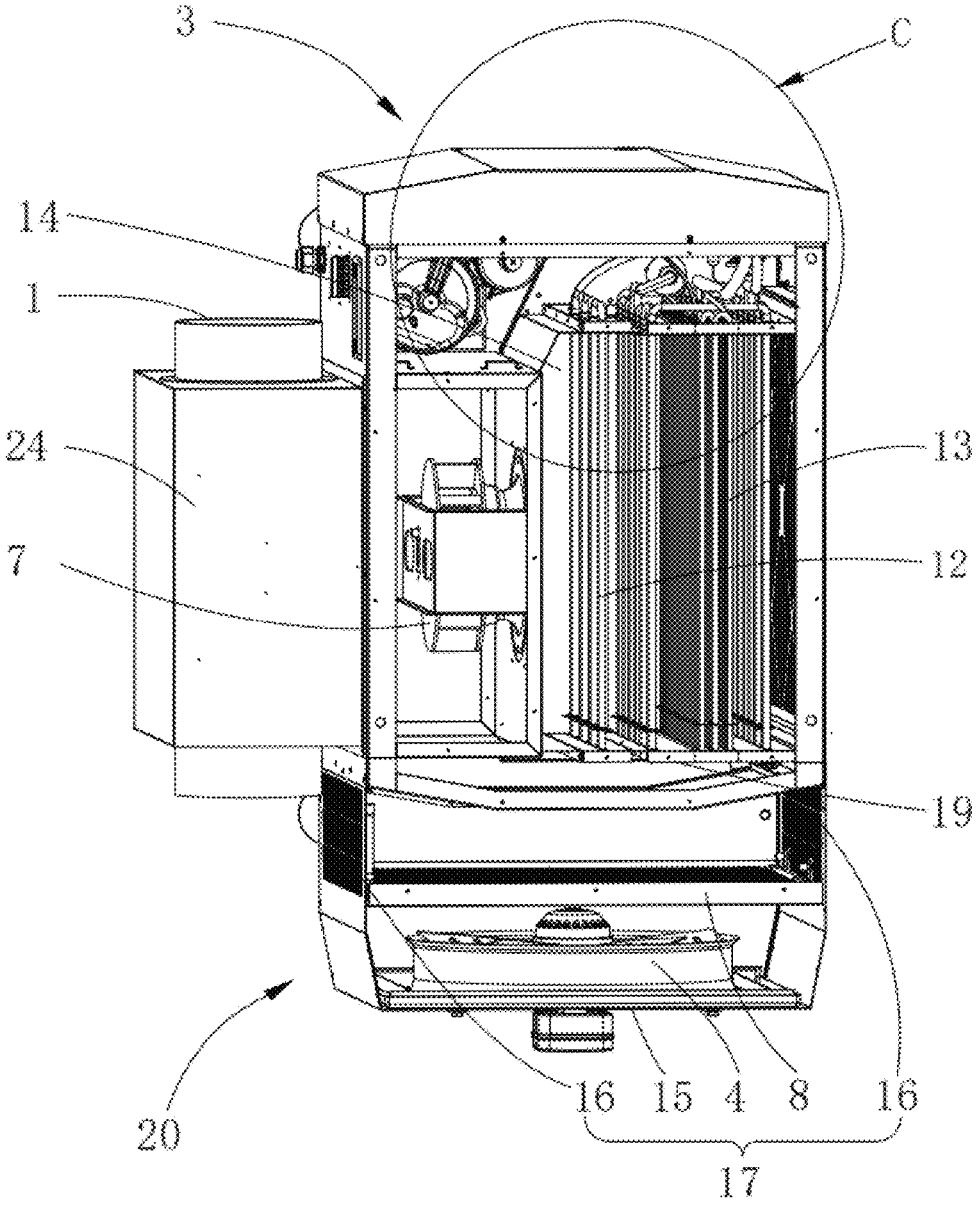
FIG. 5 is a schematic structural diagram of the multifunctional dehumidifier in FIG. 1 from another view, which shows a second air duct inlet and a first side of a second heat exchanging box.
Figure 6:
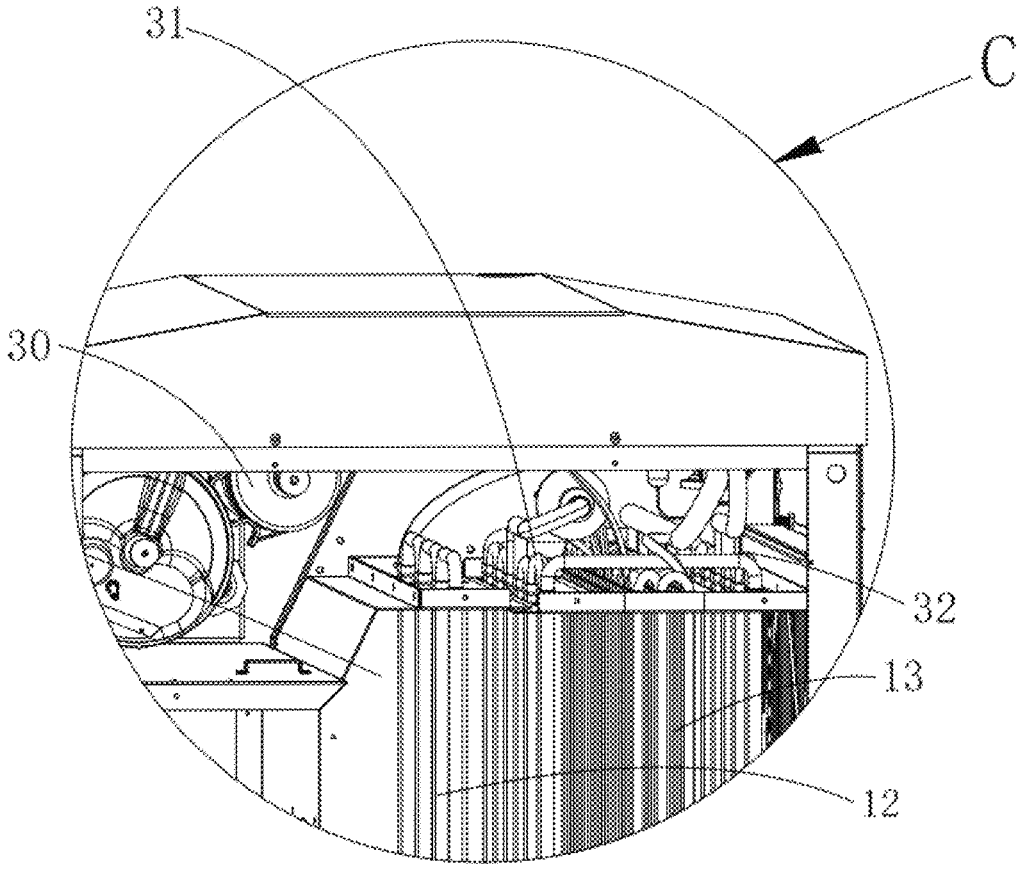
FIG. 6 is an enlarged view of area C in FIG. 5.

1 second air duct outlet, 2 second air duct inlet, 3 main body, 4 first fan, 5 first side of the main body, 7 second fan, 8 first condenser, 10 first side of a second heat exchanging box, 12 second condenser, 13 evaporator, 14 second heat exchanging box, 15 first air duct outlet, 16 first air duct inlet, 17 first air duct, 18 second air duct, 19 rear wall of the main body, 20 first heat exchanging box, 21 airflow of the second air duct, 22 airflow of the first air duct, 23 air inlet turning pipe, 24 air duct outlet turning pipe, 30 compressor, 31 first auxiliary evaporator, 32 second auxiliary evaporator, 33 expansion valve, 34 filter.

DETAILED DESCRIPTION OF THE EMBODIMENTS

The embodiments of the present disclosure are described in detail below, with examples of these embodiments shown in the accompanying drawings. In these drawings, identical or similar reference numerals throughout indicate identical or similar components or components with identical or similar functions. The embodiments described below, with reference to the drawings, are exemplary and are provided for the purpose of explaining the disclosure, and should not be construed as limiting the disclosure in any way.

In the description of the present disclosure, it should be understood that positional terms such as "up", "down", "front", "back", "left", "right", and the like, indicating orientation or positional relationships, are based on the orientation or positional relationships shown in the drawings. These terms are used solely for convenience of description and to simplify the explanation of the disclosure, and should not be understood as indicating or implying that the described device or component must have a specific orientation or be constructed and operated in a specific orientation. Therefore, these terms should not be construed as limiting the disclosure.

In the description of the present disclosure, the term "several" means one or more, the term "multiple" means two or more, terms such as "greater than", "less than", and "exceed" are understood to exclude the specified number, while terms such as "above", "below" and "within" are understood to include the specified number. If the terms "first", "second" etc., are used, they are for distinguishing technical features and should not be understood as indicating relative importance, the quantity of the technical features, or the order in which the technical features are presented.

In the description of the present disclosure, unless explicitly defined otherwise, terms such as "arranged", "installed", and "connected" should be broadly interpreted. Those skilled in the relevant technical field may reasonably determine the specific meaning of these terms in the context of the technical solution.

In the description of the present disclosure, terms like "one embodiment", "some embodiments", "exemplary embodiment", "example", "specific example", or "some examples" are used to indicate that the specific features, structures, materials, or characteristics described in connection with the embodiment or example are incorporated in at least one embodiment or example of the present disclosure. It should be understood that the use of these terms does not necessarily refer to the same embodiment or example. Moreover, the specific features, structures, materials, or characteristics described can be combined in any appropriate way in one or more embodiments or examples.

This embodiment provides a multifunctional dehumidifier. As shown in FIGS. 3-8, the multifunctional dehumidifier includes a second air duct 18, which sequentially houses an evaporator 13 and a second condenser 12 along an airflow direction. Air from outside of the multifunctional dehumidifier enters the second air duct 18 through the second air duct inlet 2, where the air first passes through the evaporator 13 to dissipate heat and cool, causing water vapor to condense. The air then passes through the second condenser 12 to absorb heat and warm up before being discharged through the second air duct outlet 1. The multifunctional dehumidifier also includes a first air duct 17, which is parallel to the second air duct 18. A first condenser 8 is provided inside the first air duct 17, which is communicated with the second condenser 12. The first condenser 8 is configured to primary release heat of refrigerant, the second condenser 12 is also configured to secondary release heat of refrigerant. A first air duct inlet 16 is provided and configured to guide the air into the first air duct 17. The first condenser 8 is configured to carry out the heat released from the second condenser 12, the first air duct outlet 15 is configured to discharge the heat carried out from the first condenser 8. The refrigerant flows through the first condenser 8 for initial heat release, and then flows to the second condenser 12 for secondary heat release. Outside air enters the first air duct 17 through the first air duct inlet 16, passes through the first condenser 8, which carries the heat released from the first condenser 8, and then exits through the first air duct outlet 15.

Specifically, when a non-heating dehumidification mode is selected, the user installs the multifunctional dehumidifier in two separated areas. The second air duct outlet 1 is placed towards the indoor, while the first air duct outlet 15 is directed towards the outdoor. The heat released by the first condenser 8 during the primary heat release process will be expelled outdoors, thus not affecting the indoor temperature. Since the second condenser 12 only performs secondary heat release, the amount of heat released is less than or equal to the amount of heat absorbed by the evaporator 13. This ensures that the air passing through the second condenser 12 absorbs no more heat than what was lost by the evaporator 13. Therefore, the outlet air temperature is not higher than the inlet air temperature, and discharging the air into the room will not noticeably alter the indoor temperature, achieving non-heating dehumidification.

For dehumidification with temperature increase, the user places the entire multifunctional dehumidifier indoor, positioning both the second air duct outlet 1 and the first air duct outlet 15 to discharge air towards the indoor area. The air from the second air duct 18 passes through the evaporator 13 for cooling and heat dissipation before traveling through the second condenser 12, where it absorbs heat and increases in temperature. The air from the first air duct 17 passes through the first condenser 8, where it absorbs heat and increases in temperature before exiting the first air duct air duct inlet 16. Since the combined heat released by the second condenser 12 and the first condenser 8 is greater than the heat absorbed by the evaporator 13 from the air exiting the second air duct 18, the air from both the second air duct 18 and the first air duct 17 will increase the indoor temperature when discharged into the room.

In some specific embodiments of the present disclosure, both the second air duct inlet 2 and the second air duct outlet 1 are oriented in a same direction as the multifunctional dehumidifier's top. The airflow direction within the second air duct 18 is as follows: air enters from a back of the second air duct inlet 2, then turns horizontally, and finally blows out from the second air duct outlet 1. That is, air enters from the second air duct inlet 2 in a reverse direction then turns horizontally, and finally exits through the second air duct outlet 1 in a forward direction.

Specifically, dust in the outside tends to fall due to gravity and is not easily carried into the multifunctional dehumidifier through the second air duct inlet 2 or the second air duct outlet 1.

In some embodiments of the present disclosure, the evaporator 13 and the second condenser 12 are located within the main body 3. The multifunctional dehumidifier includes: an air inlet turning pipe 23, an end of which serves as the second duct air duct inlet 2. The air inlet turning pipe 23 turns from backward to horizontal, and another end of the air inlet turning pipe 23 is connected to a first side wall 5 of the main body 3; and an air outlet turning pipe 24 is connected to a second side wall of the main body 3. A first end of the air outlet turning pipe 24 is located inside the main body 3, and it turns from horizontal to forward. A second end of the air outlet turning pipe 24 is served as the second air duct outlet 1.

In some embodiments of the present disclosure, the air inlet turning pipe 23 is mounted on a first side 5 of the main body 3, and the air outlet turning pipe 24 is mounted on a second side wall of the main body 3.

In some embodiments of the present disclosure, the multifunctional dehumidifier includes a first heat exchanging box 20, which is installed on the rear wall 19 of the main body. The first air duct 17 is formed inside the first heat exchanging box 20, with the first air duct outlet 15 located on the rear wall of the first heat exchanging box 20 and the first air duct inlet 16 located on the side wall of the first heat exchanging box 20.

In some embodiments of the present disclosure, multiple of the first air duct inlet 16 is provided, and the multiple of the first air duct inlet 16 are located on multiple sidewalls of the first heat exchanging box 20.

In some embodiments of the present disclosure, both the second air duct 18 and the first air duct 17 are equipped with fans, and a second fan 7 is installed in the second air duct 18, and a first fan 4 is installed in the first air duct 17.

Specifically, the first fan 4 and the second fan 7 drive air into the first air duct 17 and the second air duct 18 for heat dissipation.

In some embodiments of the present disclosure, the multifunctional dehumidifier also includes a compressor 30 and an expansion valve 33. The compressor 30 is connected to the first condenser 8, which is then connected to the second condenser 12. The second condenser 12 is connected to the expansion valve 33, and the expansion valve 33 is connected to the evaporator 13, which then connects to the compressor 30.

In some embodiments of the present disclosure, an auxiliary evaporator 13 is installed on the evaporator 13, with both evaporators interconnected, that is, the auxiliary evaporator is connected to the evaporator.

In some embodiments of the present disclosure, a separating plate is installed between the second air duct 18 and the first air duct 17. The separating plate may be the rear wall 19 of the main body 3.

Specifically, the separating plate divides the first air duct 17 and the second air duct 18, preventing heat exchange between the two airflows.

The following is a detailed description of the multifunctional dehumidifier according to an embodiment of the present disclosure, with reference to FIGS. 1 to 9. It should be understood that the following description is for illustrative purposes only and does not limit the disclosure.

Figure 7:
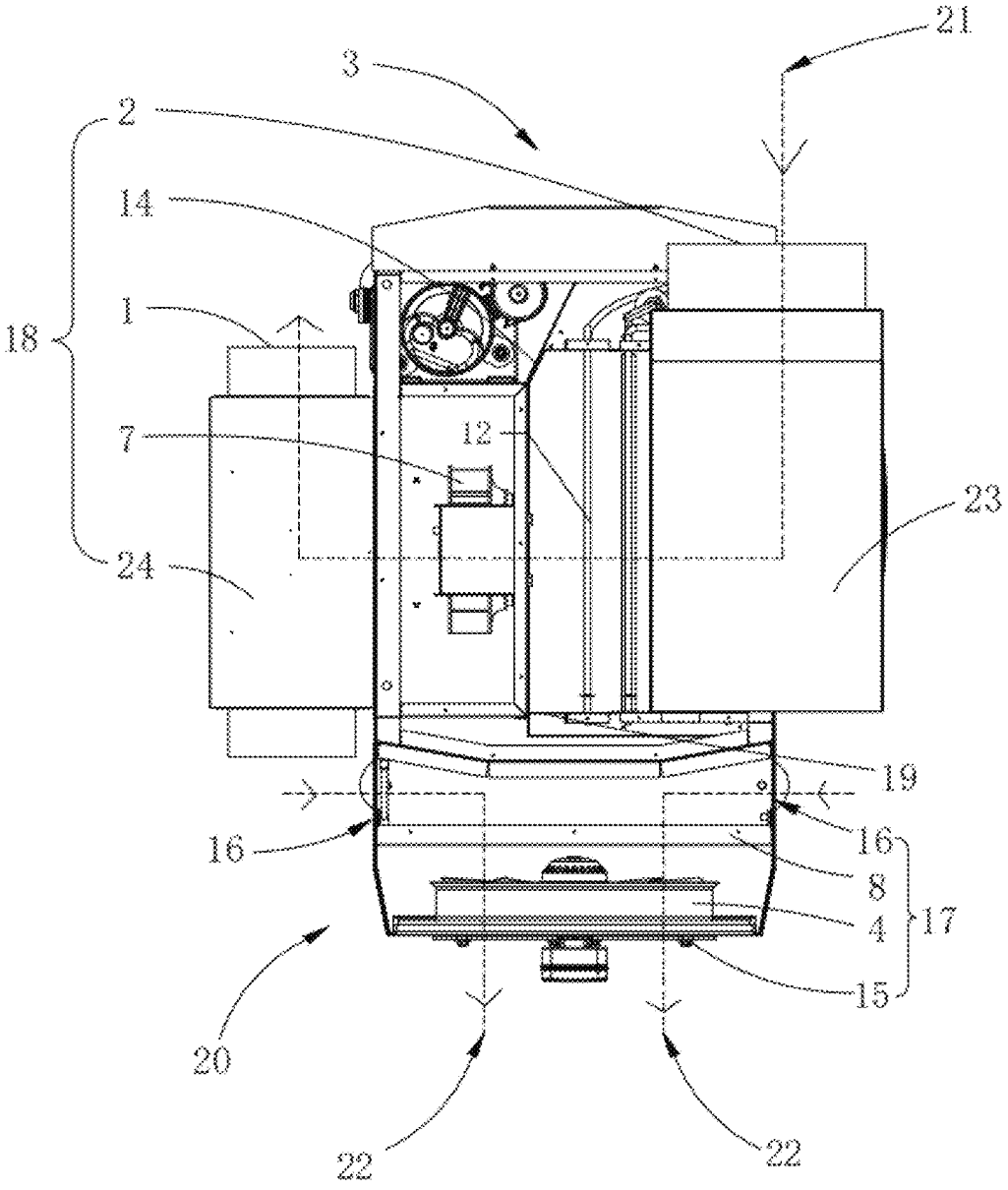
FIG. 7 is a wind path diagram of the multifunctional dehumidifier.

As shown in FIG. 7, the multifunctional dehumidifier of the present disclosure includes a main body 3, inside of which is a second air duct 18. In the direction of airflow 21 within the second air duct 18, there are sequentially arranged an air inlet turning pipe 23, a second heat exchanging box 14, a second fan 7, and an air outlet turning pipe 24. The air inlet turning pipe 23 is mounted on the first side wall 5 of the main body (see FIG. 1), with its first end as the second air duct inlet 2. The pipe turns from backward to horizontal and its second end passes through the first side wall 5 of the main body 3 to connect with the interior of the main body 3, then passes through the first side wall 10 of the second heat exchanging box 14 (see FIG. 5) to connect with the second heat exchanging box 14. Inside the second heat exchanging box 14, in the direction of airflow 21, there are sequentially arranged the evaporator 13 and the second condenser 12 (see FIG. 5). The left side wall of the second heat exchanging box 14 is provided with an opening, and the second fan 7 is installed at this opening. An air outlet turning pipe 24 is mounted on the left wall of the main body. Its first end passes through the main body 3 and the second side wall, turning from horizontal to forward, and its second end serves as the second air duct outlet 1. The airflow 21 inside the second air duct 18 enters the second air duct inlet 2, passes through the air inlet turning pipe 23, enters the second heat exchanging box 14, reaches the evaporator 13 for heat dissipation and cooling to condense water vapor, and then moves to the second condenser 12 to absorb heat and increase the temperature. Finally, it is expelled through the air outlet turning pipe 24.

As shown in FIG. 7, the rear wall 19 of the main body is equipped with a first heat exchanging box 20, inside which there is a first air duct 17. The first air duct outlet 15 is formed on the rear wall of the first heat exchanging box 20, and a first fan 4 is installed at the first air duct outlet 15. Multiple first air duct inlets 16 are located on three side walls of the first heat exchanging box 20 (see FIGS. 1 and 2). The rear wall 19 of the main body serves as a separator plate, dividing the second air duct 18 from the first air duct 17. The first condenser 8 is provided in the first air duct 17 of the first heat exchanging box 20, and the first condenser 8 is connected to the second condenser 12.

Figure 8:
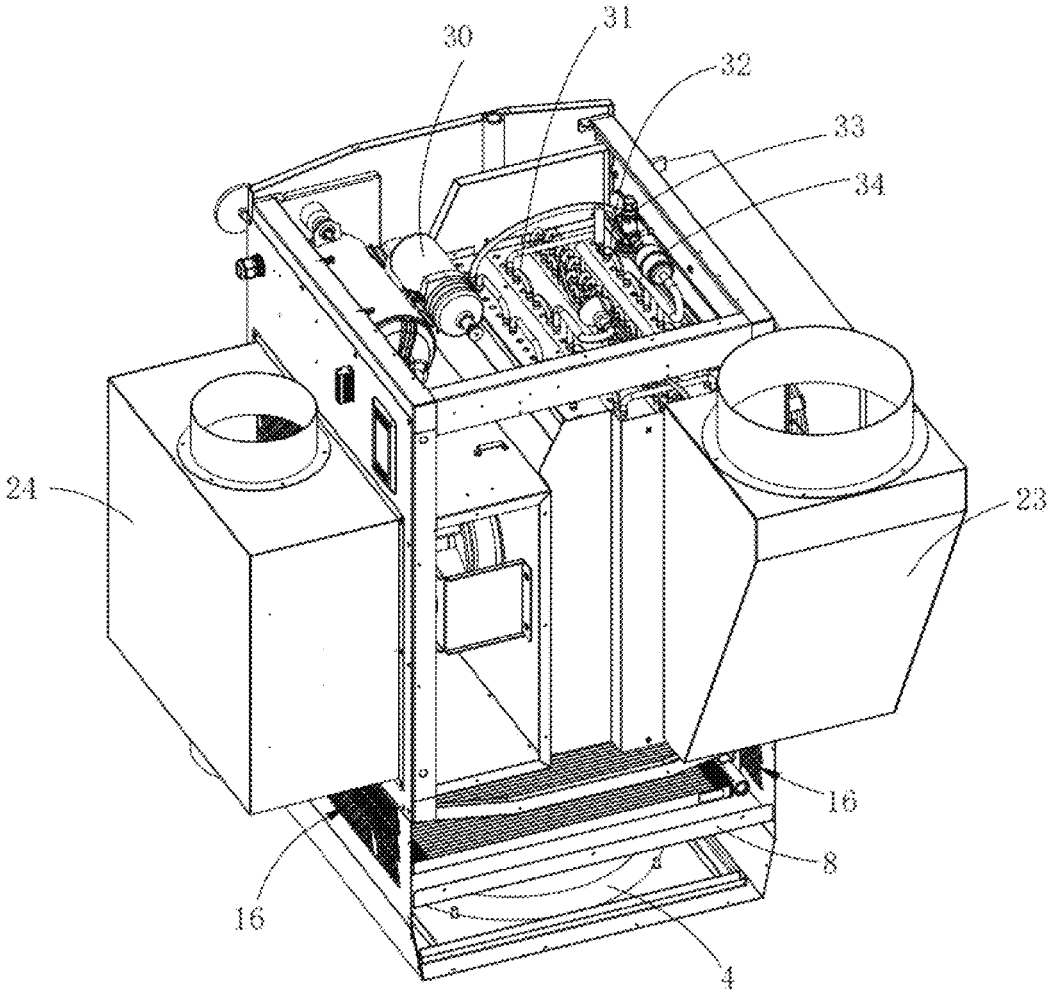
FIG. 8 is a schematic structural diagram of the multifunctional dehumidifier of FIG. 1 from another view.
Figure 9:
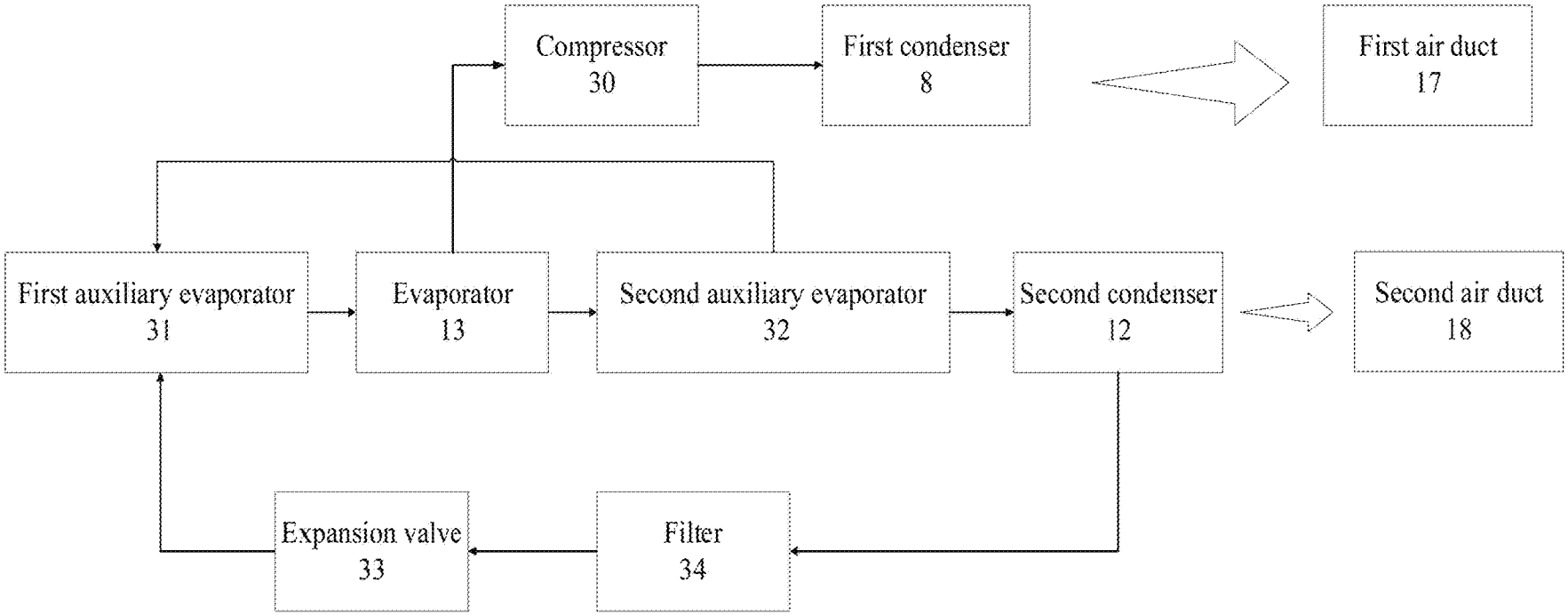
FIG. 9 is a schematic diagram of a dehumidification process of the multifunctional dehumidifier.

As shown in FIGS. 8-9, the main body also includes a compressor 30 and an expansion valve 33. The refrigerant flows from the compressor sequentially through the first condenser, the second condenser, a filter 34, the expansion valve 33, and a first auxiliary evaporator 31, then flows into both the evaporator 13 and the second auxiliary evaporator 32. The refrigerant inside the evaporator 13 flows toward the compressor 30 and the second auxiliary evaporator 32, while the refrigerant inside the second auxiliary evaporator 32 flows toward the second condenser. The first condenser 8 releases heat inside the first air duct 17, while the second condenser releases heat inside the second air duct 18. The heat exchanging area and volume of the second condenser 12 are designed based on the condensation temperature at the first condenser 8 outlet, the temperature, and airflow in the first air duct 17 after the evaporator 13, allowing partial neutralization of the refrigerant cooling capacity and providing excellent subcooling effects at the condenser end, greatly improving the dehumidification capacity and efficiency of the system.

If no temperature rise is needed during dehumidification, the user installs the multifunctional dehumidifier in two separated processing areas, positions the second air duct outlet 1 toward the indoor air, places the first heat exchanging box 20 toward the outdoor, and positions the first air duct outlet 15 toward the outdoor. Outdoor air is driven by the first fan 4 through the first air duct inlet 16 into the first air duct 17, passing through the first condenser 8, where the refrigerant undergoes primary cooling (i, e., primary heat release). The airflow 22 in the first air duct helps cool the refrigerant, which causes the air to warm. However, because the air is expelled through the first air duct outlet 15 to the outdoors, it does not raise the indoor temperature. After the refrigerant in the first condenser 8 undergoes primary cooling and its temperature decreases, it flows into the second condenser 12 for secondary cooling (i. e., secondary heat release), releasing a small amount of heat. The airflow 21 in the second air duct only absorbs the small amount of secondary heat released from the second condenser 12, which is less than or equal to the heat lost in the evaporator 13. Therefore, the outlet temperature of the second air duct 18 is not higher than the intake temperature, and the airflow expelled into the room does not significantly change the room's original temperature, achieving dehumidification without temperature rise.

If the room temperature needs to be increased during dehumidification, the user places the multifunctional dehumidifier in the indoor space and positions both the second air duct outlet 1 and the first air duct outlet 15 toward the indoor air. This setup causes the heat released by the second condenser 12 and the first condenser 8 to be discharged into the indoor space along with the airflow in the second air duct 21 and the first air duct 22. The total heat released by both the primary and secondary heat release processes is greater than the heat absorbed from the airflow 21 in the second air duct after it passes through the evaporator 13. As a result, the combined airflow from the first air duct 17 and the second air duct 18 expelled into the room will cause the indoor temperature to rise.

Through this arrangement of the multifunctional dehumidifier, at least the following effects can be achieved: If no temperature rise is needed during dehumidification, the user installs the dehumidifier in two separated processing areas, with the second air duct outlet 1 facing the room, and the first heat exchanging box 20 facing the outside with the first air duct outlet 15 directed outdoors. The primary heat released by the first condenser 8 will be discharged outdoors without affecting the room temperature. Since the second condenser 12 only releases secondary heat, the heat released is smaller than the heat absorbed by the evaporator 13, so the air leaving the second condenser 12 carries less or equal heat compared to that was lost at the evaporator, resulting in the outlet air temperature being no higher than the inlet temperature, and the air vented into the room will not significantly alter the indoor.

According to the embodiments of the multifunctional dehumidifier of the present disclosure, at least the following effects can be achieved. When non-heating dehumidification is required, the user installs the multifunctional dehumidifier in two separate treatment areas, with the outlet of the second air duct 1 facing the indoor area; the outlet of the first air duct 15 is directed towards the outdoor area. The primary heat released by the first condenser is discharged outdoors, without affecting the indoor temperature. Since the second condenser 12 only releases secondary heat, the amount of heat released is less than the amount of heat absorbed by the evaporator 13. This ensures that the heat received by the air at the second condenser 12 is less than or equal to the heat lost by the evaporator 13, meaning the outlet air temperature is not higher than the inlet air temperature. Therefore, when the air is discharged into the indoor area, it will not significantly change the original indoor temperature, achieving dehumidification without temperature increase.

When temperature-increasing dehumidification is required, the user places the entire multifunctional dehumidifier indoors, with both the outlet of the second air duct 1 and the outlet of the first air duct 15 facing indoor area. The air from the second air duct 18 first passes through the evaporator 13 to cool down before entering the second condenser 12 for heat absorption and temperature increase. The air from the first air duct 17 passes through the first condenser for heat absorption and temperature increase before leaving the first air duct inlet 16. Since the total heat supplied by the second condenser 12 and the first condenser 8 is greater than the heat absorbed by the evaporator 13 from the air leaving the second air duct 18, the air discharged from both the first air duct 17 and second air duct 18 into the indoor will cause the indoor temperature to rise.

In the description of this specification, terms like "one embodiment", "some embodiments", "illustrative embodiment", "example", "specific example", or "some examples" refer to specific features, structures, materials, or characteristics described in conjunction with the embodiment or example, which are included in at least one embodiment or example of the present disclosure. In this specification, the illustrative expressions of these terms do not necessarily refer to the same embodiment or example. Moreover, the specific features, structures, materials, or characteristics described may be combined in any one or more embodiments or examples in an appropriate manner.

Although embodiments of the present disclosure have been shown and described, those skilled in the art will understand that various changes, modifications, substitutions, and variations can be made to these embodiments without departing from the principles and spirit of the present disclosure. The scope of the present disclosure is defined by the claims and their equivalents.

What is claimed is:

1. A multifunctional dehumidifier, wherein, comprising a second air duct, and an evaporator and a second condenser are sequentially arranged in the second air duct; a second air duct inlet is configured to guide air into the second air duct, the evaporator is configured to cool the wind and release water vapor, and the second condenser is configured to heat the water vapor to obtain heated water vapor, and a second air duct outlet is provided and configured to discharge the heated water vapor;

wherein, the multifunctional dehumidifier also comprises a first air duct, and a first condenser is installed inside the first air duct, the first condenser is connected to the second condenser; the first condenser is configured to primary release heat of refrigerant, the second condenser is configured to secondary release heat of refrigerant; and a first air duct inlet is provided and configured to guide the air into the first air duct, the first air duct outlet is configured to discharge the heat carried out from the first condenser;

the second air duct and the first air duct are separated by a rear wall of a main body;

the second air duct inlet and the second air duct outlet are defined on a top of the multifunctional dehumidifier; an airflow direction in the second air duct is as follows: air enters from a back of the second air duct inlet, then turns horizontally, and finally blows out from the second air duct outlet;

the evaporator and the second condenser are installed inside the main body of the multifunctional dehumidifier; and the multifunctional dehumidifier further comprises an air inlet turning pipe, with an end of the air inlet turning pipe is served as the second air duct inlet and another end of the air inlet turning pipe is connected to the main body; and the multifunctional dehumidifier further comprises an air duct outlet turning pipe, an end of air duct outlet turning pipe is connected the main body, and another end of the air duct outlet turning pipe is served as the second air duct outlet;

the air inlet turning pipe is installed on a first side of the main body, and the air duct outlet turning pipe is installed on a second side of the main body.

2. The multifunctional dehumidifier according to claim 1, wherein the multifunctional dehumidifier further comprises a first heat exchanging box, which is installed on the rear wall of the main body; the first air duct is defined within the first heat exchanging box, with the first air duct outlet positioned on the rear wall of the first heat exchanging box and the first air duct inlet positioned on a sidewall of the first heat exchanging box.

3. The multifunctional dehumidifier according to claim 2, wherein a multiple of first air duct inlets are provided, and multiple of the first air duct inlets are located on multiple sidewalls of the first heat exchanging box.

4. The multifunctional dehumidifier according to claim 1, wherein a second fan is installed in the second air duct, and a first fan is installed in the first air duct.

5. The multifunctional dehumidifier according to claim 1, wherein the multifunctional dehumidifier further comprises a compressor and an expansion valve;

wherein the compressor is connected to the first condenser, and the first condenser is connected to the second condenser; and the second condenser is connected to the expansion valve, the expansion valve is connected to the evaporator, and the evaporator is connected to the compressor.

6. The multifunctional dehumidifier according to claim 1, wherein a first auxiliary evaporator and a second auxiliary evaporator are installed on the evaporator, the first auxiliary evaporator and the second auxiliary evaporator are connected to the evaporator.

* * * * *